United States Patent [19]

Fichte et al.

[11] Patent Number: 4,569,691

[45] Date of Patent: Feb. 11, 1986

[54] METHOD OF MAKING FERROBORON AND FERROBOROSILICON ALLOYS AND THE ALLOYS MADE BY THIS METHOD

[75] Inventors: Rüdolf Fichte, Nuremberg; Friedrich Breuer, Eschweiler; Reinhard Hähn, Schwabach-Limbach; Hans-Joachim Retelsdorf, Zirndorf, all of Fed. Rep. of Germany

[73] Assignee: GfE Gesellschaft für Elektrometallurgie mbH, Düsseldorf, Fed. Rep. of Germany

[21] Appl. No.: 710,969

[22] Filed: Mar. 12, 1985

[30] Foreign Application Priority Data

Mar. 14, 1984 [DE] Fed. Rep. of Germany ..... 3409311

[51] Int. Cl.[4] ..... C22B 4/00

[52] U.S. Cl. ..... 75/10 R; 75/123 B

[58] Field of Search ..... 75/10 R, 123 B

[56] References Cited

U.S. PATENT DOCUMENTS 4,486,226 12/1984 Hildebrand ..... 75/10 R

*Primary Examiner*—Peter D. Rosenberg

*Attorney, Agent, or Firm*—Karl F. Ross; Herbert Dubno

[57] ABSTRACT

A method of making ferroboron or ferroborosilicon alloys in a low-shaft electrical furnace wherein the burden or charge has at least as a major portion of its carbon carrier, wood chips or particles which are carbonized to wood charcoal during the process and thus the charge has a porosity which permits adsorption action to prevent loss of volatile boron compounds. The charge also contains iron oxide and boron oxide, the electrodes of the furnace effecting a reduction of the boron oxide at a reduction zone just above the floor of the furnace.

12 Claims, 1 Drawing Figure

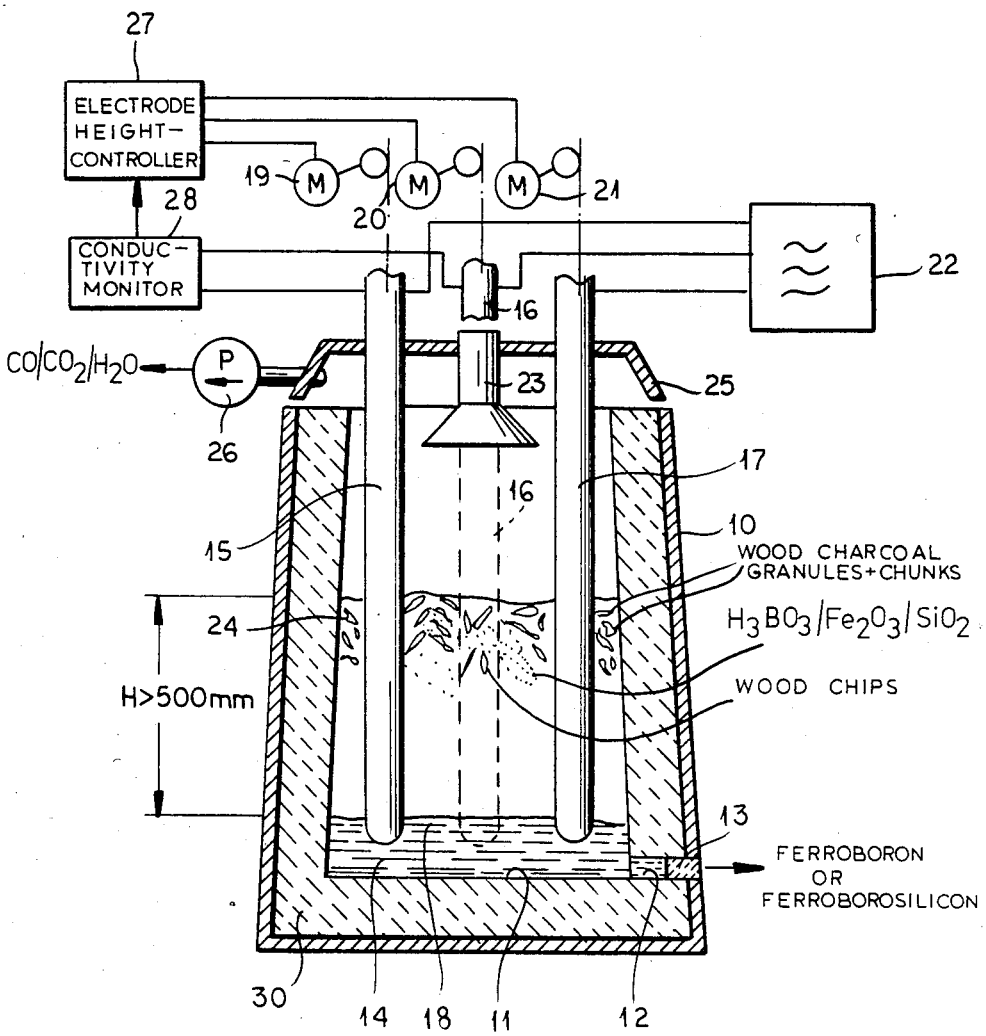
27
ELECTRODE HEIGHT-CONTROLLER
28
CONDUC-TIVITY MONITOR
19
M
20
M
M
21
22
16
CO/CO2/H2O
P
26
23
25
17
16
15
10
WOOD CHARCOAL GRANULES+CHUNKS
24
H3BO3/Fe2O3/SiO2
H>500mm
WOOD CHIPS
13
FERROBORON OR FERROBOROSILICON
30
14
18
11
12

METHOD OF MAKING FERROBORON AND FERROBOROSILICON ALLOYS AND THE ALLOYS MADE BY THIS METHOD

FIELD OF THE INVENTION

Our present invention relates to a method for the carbothermic production of ferroboron alloys or ferroborosilicon alloys by the reduction of oxidic boron raw materials in the presence of an oxidic iron carrier and a carbon material. More particularly, the invention relates to a method for this purpose which is carried out in an electrical furnace and, specifically, in a low-shaft electrical furnace from which the alloy is tapped at the bottom and a charge containing the various reactants is disposed above the melt of the alloy. The invention also relates to new alloys produced by this method.

BACKGROUND OF THE INVENTION

The production of ferroboron has generally been carried out by aluminothermic reaction, the oxidic boron containing new material and iron oxide being reduced with the aluminum and smelted. The product is usually an aluminum-containing ferroboron which consists of say 15 to 18% by weight boron, up to about 4% by weight aluminum, a maximum of 1.0% by weight silicon, a maximum of 0.10% by weight carbon, the balance being iron and the usual impurities or trace elements associated with iron.

Alternatively, the aluminothermic method can produce a product which contains 18 to 20% by weight boron, up to 2% by weight aluminum, a maximum of 2% by weight silicon, a maximum of 0.10% by weight carbon, the balance being iron and unavoidable elements which do not materially affect the properties of the product.

These ferroboron compositions often are desirable for use in the production of metallic glasses and for this purpose the presence of aluminum is detrimental since the aluminum is easily oxidized and the resulting oxides interfere with the formation of the metallic glasses. Similar disadvantages reside in the use of aluminothermic and like methods for the formation of ferroborosilicon.

Consequently, when the alloys are to be used in the production of metallic glasses, it is common to use a carbothermic reduction of the oxidic boron and iron carriers, thereby producing low aluminum ferroboron alloys or ferroborosilicon alloys.

The procedure can be carried out in an electrical furnace using a charge or burden which employs as its carbon carrier the finely divided materials such as milled coal or milled coke.

Since the charge must be gas permeable, with prior art systems it is almost inevitable that the charge height, i.e. the layer of the particulate burden, must not exceed 500 mm and generally must be less than 500 mm.

With such low-height charges or burdens, however, full drying of the charge to the extent that it might be moist, in many cases is not achieved, but even more significant is the fact that with such low-height charges, the burden content of the product is markedly reduced.

It is true that using this carbothermic technique one can obtain ferroboron alloys or ferroborosilicon alloys that are practically free from detrimental contents of aluminum, the aluminum content being held generally to a maximum of 0.07% by weight. However, as noted, the boron content is then generally too low and the yield or recovery is unsatisfactory. For instance in the production of a ferroboron alloy, the boron content will generally be about 10% by weight. In the production of a ferroboron alloy the boron content is generally reduced to about 3% by weight for a silicon content of 3% by weight.

Efforts have been made to overcome this drawback by agglomerating the burden mixture or charge into comparatively large-size pellets so that within the furnace chamber a greater thickness of the burden comprised of the pelletized charge can be used. This, however, has also proved to be unsuccessful, and it can be said that the results obtained are basically no different even though one would expect the porosity of the burden to be increased.

OBJECTS OF THE INVENTION

It is the principal object of the present invention to provide a process for the production of ferroboron alloys and ferroborosilicon alloys, utilizing the carbothermic method or technique whereby the drawbacks of earlier methods are avoided.

Another object of this invention is to provide a carbothermic method for producing ferroboron and ferroborosilicon alloys which are low in aluminum content and yet have a comparatively high boron content, the process having significantly greater yields with reduced energy consumption.

Yet another object of the invention is to provide an improved method of making ferroboron and ferroborosilicon alloys of such quality and characteristics that they can be used in the production of metallic glasses.

Another object of our invention is to provide ferroboron and ferroborosilicon alloys which are especially amenable to use in the production of metallic glasses.

SUMMARY OF THE INVENTION

The method of the present invention provides a carbothermic reduction of a burden consisting of oxidic boron carrier, carbon and iron oxide in a low-shaft electrical furnace, preferably with vertically adjustable electrodes and having a furnace base immediately above which is provided a reduction zone into which the electrodes extend, the burden consisting essentially of the finely divided boron oxide raw material, finely divided iron oxide and fine granular silicon dioxide as well as carbon carriers. With the invention, a gas-permeable burden or charge is provided while proximal to the floor of the furnace where the ferroboron and ferroborosilicon collect, the furnace can be tapped to discharge these alloys.

According to the invention, the aforedescribed objects are attained utilizing a burden or charge whose carbon carrier is present in an amount of 35 to 65% by weight of pieces of wood, measured with respect to the total amount of carbon carrier, these pieces of wood having a size of 5 to 250 mm, the pieces having major dimensions of 5 to 250 mm, the height of the charge or burden being selected to be at least sufficient to dry and carbonize the wood, i.e. dry it to wood charcoal.

The invention is based upon our discovery that the iron oxide may be reduced even at low temperatures, theoretically temperatures as low as 720° C., by carbon monoxide and carbon, reactions which occur in the upper region of the burden or charge.

This is effected, according to the invention, in the upper region of the burden or charge whose thickness is so great that it is possible to treat it in terms of a column.

The fact that a true column is provided in accordance with the present invention enables the iron oxide to be reduced at comparatively low temperatures at the upper part of the column, e.g. at temperatures which can be theoretically around 720° C., using carbon monoxide and carbon, the carbon being present throughout the column and the carbon monoxide rising from lower portions of the column and the reaction zone, as well as being generated at the upper part of the column.

At the upper part of the column, therefore, a reduction of the metallic iron is effected in accordance with the relationships:

$$Fe_2O_3+3CO=2FeO+3CO_2$$

$$FeO+C=Fe+CO.$$

In the reduction zone for the oxidic boron compounds, generally represented as $B_2O_3$, the latter being formed by the thermal decomposition of boric acid, for example, to the boron oxide and water vapor, the boron oxide is reduced with carbon in accordance with the relationship:

$$B_2O_33C=2B+3CO.$$

This reaction which requires a temperature of at least 1600° C. can be effected in the reaction zone, which is also termed a reduction zone hereinafter, generates carbon monoxide which rises to the upper portion of the column and reduces the iron oxide to the finely divided and highly active metallic iron.

In the reduction zone into which the electrodes extend to generate the requisite high temperature, the reduction of the boron oxide is effected in the presence of the finely divided iron so that the net reaction is:

$$B_2O_3+3C+2Fe=2FeB+3CO.$$

Correspondingly when the charge contains silicon dioxide, the relationship may be represented as:

$$B_2O_3+7C+2Fe+2SiO_2=2FeBSi+7CO.$$

Consequently either ferroboron or ferroborosilicon or compositions of the two in nonstoichiometric relationships and thus having selectively variable proportions of iron, boron and silicon can be made in accordance with the invention.

The invention has numerous advantages.

Firstly, the reaction is complete and the energy consumption is low based upon the yield of ferroboron or ferroborosilicon.

The boron content of the product is especially high and the boron oxide consumption relatively low because any volatile boron oxide is trapped and participates anew in the process from the upper levels of the column in which it is trapped.

The boron oxide recovery and recycling is autogenous and thus the burden or charge acts both as a filter and a condenser.

Since we have not found a similar phenomenon with earlier methods or producing ferroboron and ferroborosilicon, we are inclined to attribute this unique function to the adsorptive action of the wood charcoal which is introduced and/or is formed by a carbonization of the raw wood.

It is possible and a reasonable explanation that in the lower portion of the burden in the region at which the boric acid tends to volatilize, the boric acid is taken up in the pores of the wood charcoal and thus becomes available for the reduction reaction and is not lost, while a cementing of the burden or charge, which might be expected to result from volatilization of boric acid and subsequent condensation and solidification, is precluded.

The low-shaft electrical furnace can thus be operated in a dry mode with the wood being converted dry to the wood charcoal.

In a preferred embodiment of the invention, the burden can have a thickness (layer or column height) which may be maintained at 500 mm or more in which the wood is carbonized to wood charcoal and the wood charcoal is further subjected to a coking reaction.

With such layer thicknesses of the burden, we can operate with especially finely divided boron oxide raw materials, iron oxides and silicon dioxide, all of the components of the burden except the wood and the wood charcoal being practically in pulverulent form without impeding porosity of the charge.

Naturally, the amount of wood or wood charcoal which should be used should be equivalent to the amount required to provide carbon in a stoichiometric excess above that required for the reduction reactions.

Preferably the burden should have a layer thickness or column height of 800 to 1200 mm with best results being obtained say at 1000 mm, the thickness or column height of the burden being maintained continuously during the alloy-producing operation. These values have been found to be effective with furnaces having an energy consumption of 500 to 1500 kVa. The carbon carrier, generally wood charcoal granules, should have a particle size which is at most about 3 mm, although we can use finely divided carbon carriers as well. The method of the invention is also operative with agglomerated burden compositions of the aforedescribed type.

According to another feature of the invention, ferroboron alloys are produced for use in the fabrication of metallic glasses with an aluminum content below 0.2% by weight and composed of 15 to 25% by weight boron and the balance iron with not more than 0.2% by weight of impurities from Group II of the Periodic Table or mixtures thereof. In this case, the preferred boron content is about 19% by weight.

For the production of ferroborosilicon alloys, again the aluminum content should be less than 0.2% by weight, the alloy consisting essentially of 3 to 15% by weight boron, 40 to 10% by weight silicon, the balance iron and not more than 0.2% by weight of impurities from Group II of the Periodic Table or mixtures thereof.

The preferred alloy contains 10% by weight boron, about 24% by weight silicon, the balance iron.

BRIEF DESCRIPTION OF THE DRAWING

The above and other objects, features and advantages of the present invention will become more readily apparent from the following description, reference being made to the sole FIGURE of the accompanying drawing which is a diagrammatic vertical section through a schematically represented low-shaft electric furnace in accordance with the present invention.

SPECIFIC DESCRIPTION

In the drawing, we show a low-shaft electric-arc furnace 10 having a hearth 11 at the level of which a tapping hole 12 is provided having a plug 13 which can be penetrated to tap a melt 14 of ferroboron or ferroborosilicon from the furnace.

Three electrodes 15, 16, 17 extend downwardly into the melt to define immediately above the bottom 11 of the furnace, the reduction zone 18, electrodes being vertically shiftable, e.g. by motors 19, 20, and 21 whose pinions can engage respective racks connected with these electrodes.

The three-phase source 22 energizes these electrodes which are disposed in a triangular array. A charing device 23 opens into the top of the furnace for continuously feeding the components of the burden or charge 24 into the latter to maintain a substantially constant charge height H in excess of 500 mm as previously described.

A hood has been shown diagrammatically at 25 to be connected to a suction blower 26 for evacuating water vapor, carbon monoxide and carbon dioxide which may be formed in the furnace.

The motors 19, 20, 21 are controlled by an electrode height-controller 27 which receives its input from a conductivity monitor 28 connected across at least two of the electrodes for monitoring the electrical conductivity between them and hence the depth to which the electrodes are immersed in the melt.

The furnace shown in the drawing operates in the manner already described, i.e. at the upper portion of the charge or burden 24, iron is formed by reduction of iron oxide with rising carbon monoxide while reduction of the boron oxide and the silicon dioxide takes place in the reduction zone 18. The burden 24 is composed, as indicated, of a carbon carrier in the form of wood charcoal granules and chunks and also wood chips or sawdust which are carbonized. The term "finely divided" as used herein will be understood to mean a particle size up to 5 mm.

SPECIFIC EXAMPLE

A three-phase low-shaft electrical furnace having a power of 300 kW with a tamped lining 30 of carbon, a hearth area of 0.785 $m^2$ and a column height of 800 mm is continuously supplied with a charge of the following proportions:

100 kg technical grade boric acid $H_3BO_3$ (57.1% $B_2O_3$)
93.5 kg iron oxide ($Fe_3O_3$) containing 69.9% Fe
51.5 kg wood charcoal grains with a particle size of 1 to 3 mm and 73.36% $C_{fix}$
50 kg wood sawdust and chips with a particle size ranging from 5 to 250 mm.

The furnace is operated for 40 hours and after each 3 to 4 hours of operation, 1,358 kg of ferroboron with an average of 19.6% by weight boron, is tapped. Eleven tappings are carried out in all.

The electrical current consumption is found to be greatly reduced by comparison with other carbothermic methods and the yield based upon boron is about 95%.

We claim:

1. A method of producing an iron and boron-containing alloy which comprises the steps of:

(a) maintaining a porous charge consisting essentially of reducible alloying components including oxidic boron compounds and iron oxide, and a carbon carrier consisting at least in major part of wood and wood charcoal above a reduction zone of a low-shaft electrical furnace, said molten alloy collecting on a floor of said furnace;

(b) electrically heating said reduction zone by passing an electric current between a plurality of electrodes extending into said reduction zone just above the floor of said furnace to effect a reduction reaction therein, thereby forming said alloy and producing carbon monoxide to reduce iron oxide at an upper portion of said charge; and (c) maintaining the thickness of said charge in said furnace during the formation of the alloy and dry carbonizing said pieces of wood in said charge to wood charcoal, said pieces of wood representing 35 to 65% of the total carbon carrier and being of a particle size of substantially 5 to 250 mm;

said dry carbonization and said reductions of oxidic boron and iron oxide all being conducted within said electrical furnace.

2. The method defined in claim 1 wherein said thickness is at least 500 mm.

3. The method defined in claim 2 wherein said thickness is substantially 800 to 1200 mm for a furnace with an energy consumption of 500 kVA to 1500 kVA.

4. The method defined in claim 3 wherein said thickness is about 1000 mm.

5. The method defined in claim 1 wherein said wood charcoal is in the form of grains having a particle size of at most 3 mm.

6. The method defined in claim 1 wherein said charge consists of agglomerates of the components thereof.

7. A ferroboron alloy made by the method of claim 1, containing less than 0.2% by weight aluminum and suitable for the production of metallic glasses.

8. The alloy defined in claim 7 which has a boron content of 15 to 25% by weight, the balance iron and a total of not more than 0.2% by weight of impurities selected from the Group II of the Periodic Table or mixtures thereof.

9. The alloy defined in claim 8 having a boron content of about 19% by weight.

10. The alloy defined in claim 7 in the form of a ferroborosilicon alloy for the production of metallic glasses.

11. The ferroborosilicon alloy of claim 10 which consists of 3 to 15% by weight boron, 40 to 10% by weight silicon and the balance iron with not more than 0.2% by weight of impurities of Group II of the Periodic Table.

12. The ferroborosilicon alloy defined in claim 11 having a boron content of about 10% by weight and a silicon content of about 24% by weight.

* * * * *